US005697686A

United States Patent [19]

Miller et al.

[11] Patent Number: 5,697,686

[45] Date of Patent: Dec. 16, 1997

[54] LAPTOP COMPUTER CART

[75] Inventors: Joseph E. Miller, Naples, Fla.; James M. Holler, Jamestown, N.Y.; James G. Fiala, Wayland, Mass.

[73] Assignee: Bush Industries, Inc., Jamestown, N.Y.

[21] Appl. No.: 592,224

[22] Filed: Jan. 26, 1996

Related U.S. Application Data

[60] Provisional application No. 60/002,692 Aug. 23, 1995.

[51] Int. Cl.[6] ..... A47B 17/03

[52] U.S. Cl. ..... 312/194; 312/293.1; 312/349; 108/143

[58] Field of Search ..... 312/293.1, 330.1, 312/194, 311, 310, 317.3, 349; 108/102, 143, 26, 182

[56] References Cited

U.S. PATENT DOCUMENTS

| | | | |
|---|---|---|---|
| 1,985,412 | 12/1934 | Jackson | 312/330.1 |
| 2,664,147 | 12/1953 | O'Keefe et al. | 108/143 |
| 2,664,331 | 12/1953 | Glotfelter | 312/194 |
| 3,910,659 | 10/1975 | Peterson | 312/311 |
| 4,184,433 | 1/1980 | Green | 108/26 |

*Primary Examiner*—Peter M. Cuomo
*Assistant Examiner*—Gerald A. Anderson
*Attorney, Agent, or Firm*—Webb Ziesenheim Bruening Logsdon Orkin & Hanson, P.C.

[57] ABSTRACT

The present invention relates to a portable laptop computer cart having a slidable desktop movable between a closed, retracted position and an open position which exposes a hidden bin/storage area underneath. The cart is mounted on casters or wheels for easy movement. Additionally, with the desktop in the retracted position, the bin is completely hidden from view allowing the cart to be utilized as a conventional end table or the like. The laptop computer cart is particularly well adapted for use with a laptop computer cart or video game entertainment system while the user is seated upon a couch or sofa.

17 Claims, 4 Drawing Sheets

LAPTOP COMPUTER CART

This application claims the benefit of co-pending Provisional Application Serial No. 60/002,692 filed on Aug. 23, 1995.

BACKGROUND OF THE INVENTION

The present invention relates to portable stands or carts and, in particular, the present invention relates to stands or carts adapted for use with laptop computers and entertainment systems.

SUMMARY OF THE INVENTION

The present invention relates to portable laptop computer carts having a slidable desktop movable between a closed, retracted position and an operable position exposing a hidden bin/storage area underneath. In the operable position, the cart is well suited for use with laptop computers or various video game entertainment systems or the like. The cart of the present invention is preferably mounted on casters or wheels for movement to the appropriate location. Additionally, with the movable desktop in the retracted position, the bin is preferably completely hidden from view, allowing the cart to be used as a conventional end table or the like.

BRIEF DESCRIPTION OF THE PREFERRED EMBODIMENTS

Figure 1:
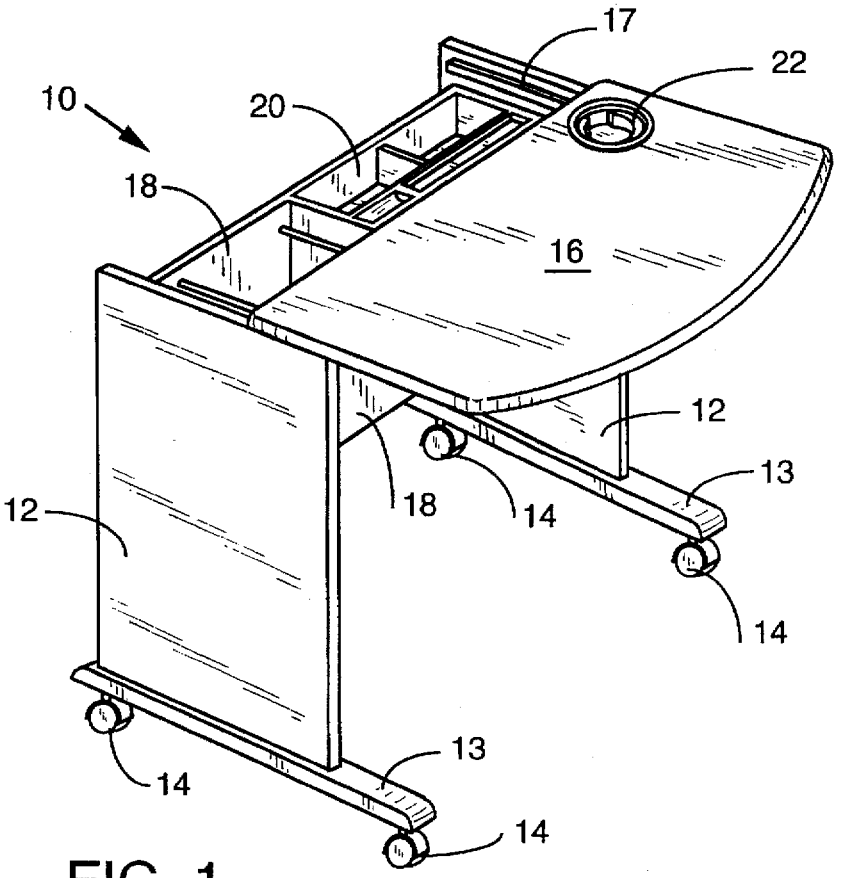
FIG. 1 is a perspective view of a laptop computer cart according to a first embodiment of the present invention with a desktop thereof in an open position.
Figure 2:
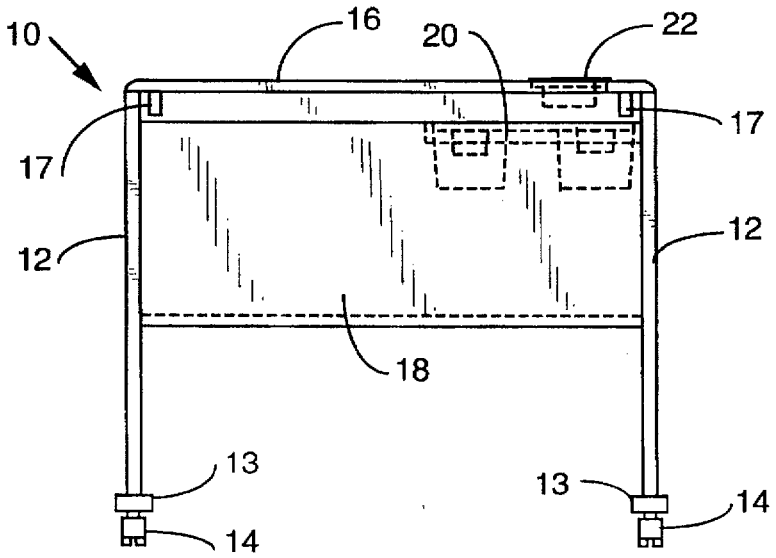
FIG. 2 is a front view of the laptop computer cart illustrated in FIG. 1.

A laptop computer cart 10 according to a first embodiment of the present invention is illustrated in FIGS. 1–4. The cart 10 includes a pair of substantially vertical end panels 12 spaced apart from each other and attached to horizontally extending braces 13 which are supported on casters or wheels 14. A slidable desktop 16 extends across the end panels 12 and is intended to serve as a desktop for the user. The desktop 16 is slidable on conventional roller tracks 17 relative to the end panels 12. The braces 13 provide stability and support for the cart 10 when the desktop 16 is in the open position as will be discussed. The desktop 16 is preferably 25" to 27" above the floor which, together with the slidability of the desktop 16, makes the cart 10 particularly well adapted for use at a couch or sofa.

Figure 3A:
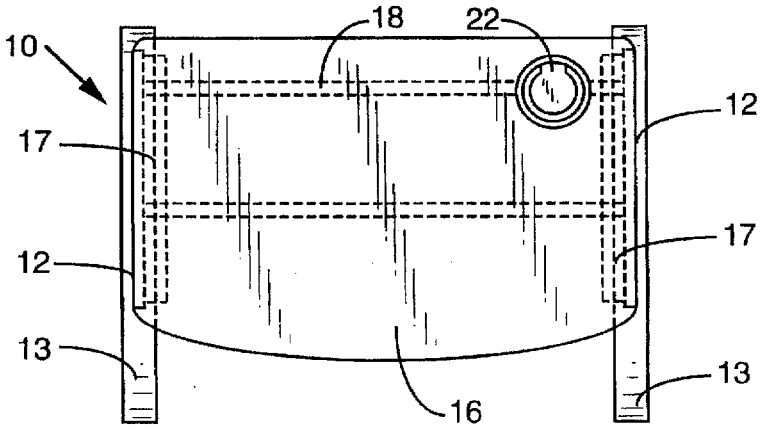
FIG. 3A is a plan view of the laptop computer cart illustrated in FIG. 1 with the desktop in a closed position.
Figure 3B:
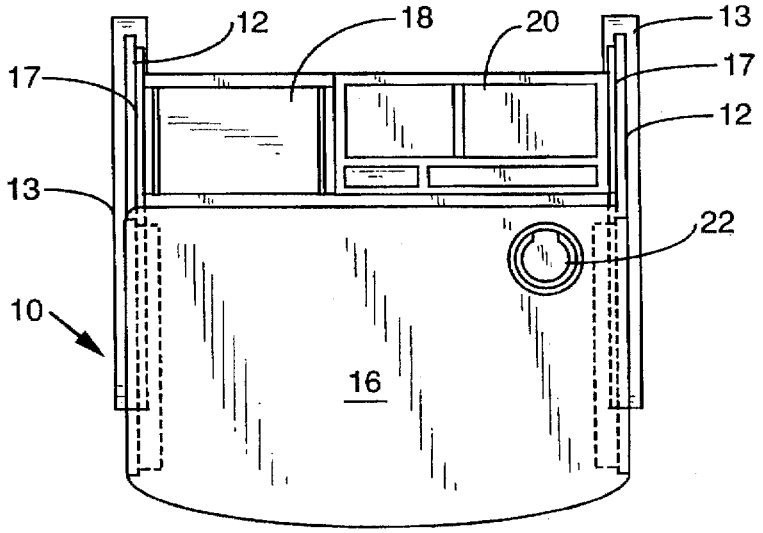
FIG. 3B is a plan view of the laptop computer cart illustrated in FIG. 1 with the desktop in the open position.
Figure 4:
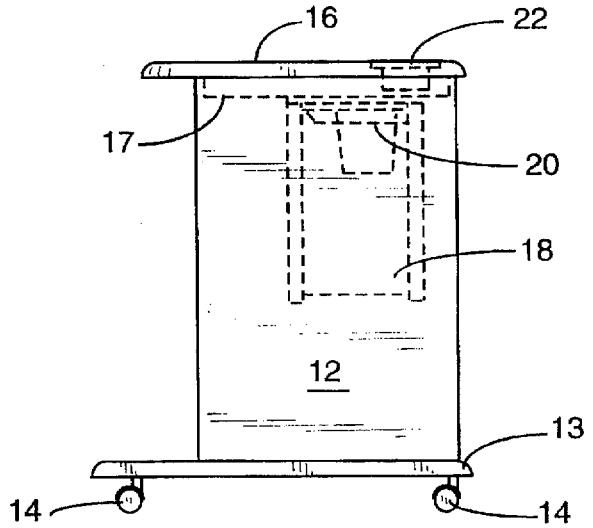
FIG. 4 is a side view of a laptop computer cart illustrated in FIG. 1 with the desktop in the closed position.

Beneath the desktop 16 is a hidden bin 18 formed by a pair of spaced vertical plates extending between the end panels 12 and a horizontal plate connecting the spaced, vertically extending plates at the bottom thereof to form bin 18 as best illustrated in FIG. 4. The bin 18 is intended to serve as a storage area for various components of a laptop computer such as diskettes, power cords, battery packs, etc. The bin 18 may also store a collection of video games together with the video game entertainment system. The bin 18 may also be utilized to store file folders and any other appropriate materials. A plastic tray 20 is removably provided on the bin 18, preferably on only one-half of the bin 18 as illustrated in FIG. 1. The tray 20 is preferably formed of plastic and has a preformed compartment therein particularly adapted for receiving computer diskettes, pencil trays or the like to assist in storage of appropriate components. Additionally, the desktop 16 may be provided with a cup-holding receiver 22 formed as a depression therein. The depression is partially circular in plan view with a generally rectangular portion in one part thereof as shown in the figures. The cup-holding receiver 22 is suited to receive a coffee cup, soft drink cans as well as rectangular juice boxes. By forming the cup-holding receiver 22 in the desktop 16, it assures that the cup-holding receiver 22 is positioned close to the user during operation. In operation, the slidable desktop 16 is slid toward the user to an open position exposing and providing access to the storage bin 18 as shown in FIGS. 1 and 3B. The cart 10 is particularly well adapted for use with a laptop computer or an entertainment system such as a NINTENDO® video game system, etc. The height of the desktop 16 is selected to accommodate a user on a couch or sofa. Consequently, the cart 10 is also conveniently utilized as a snack table for eating a meal on a sofa or couch. The width of the desktop 16 may be selected, as appropriate. However, a width between 28" and 32" has been found to be particularly effective. In the open position, the desktop 16 provides a supporting surface for a laptop computer or video game entertainment system or the like, while simultaneously permitting access to the storage bin 18 which would store peripherals associated with the laptop computer or video game entertainment system (i.e., diskettes, video game cartridges, controllers, etc.). The braces 13 extend forward beyond the end panels 12 to provide a stable base for the laptop computer cart 10 with the desktop 16 in the forward open position. When not in operation, the desktop 16 is moved to the retracted or closed position shown in FIGS. 3A and 4, completely hiding the storage bin 18, allowing the cart 10 to operate as a conventional end table or the like. Stops are provided to hold the desktop 16 in the closed position during movement of the cart 10.

Figure 5:
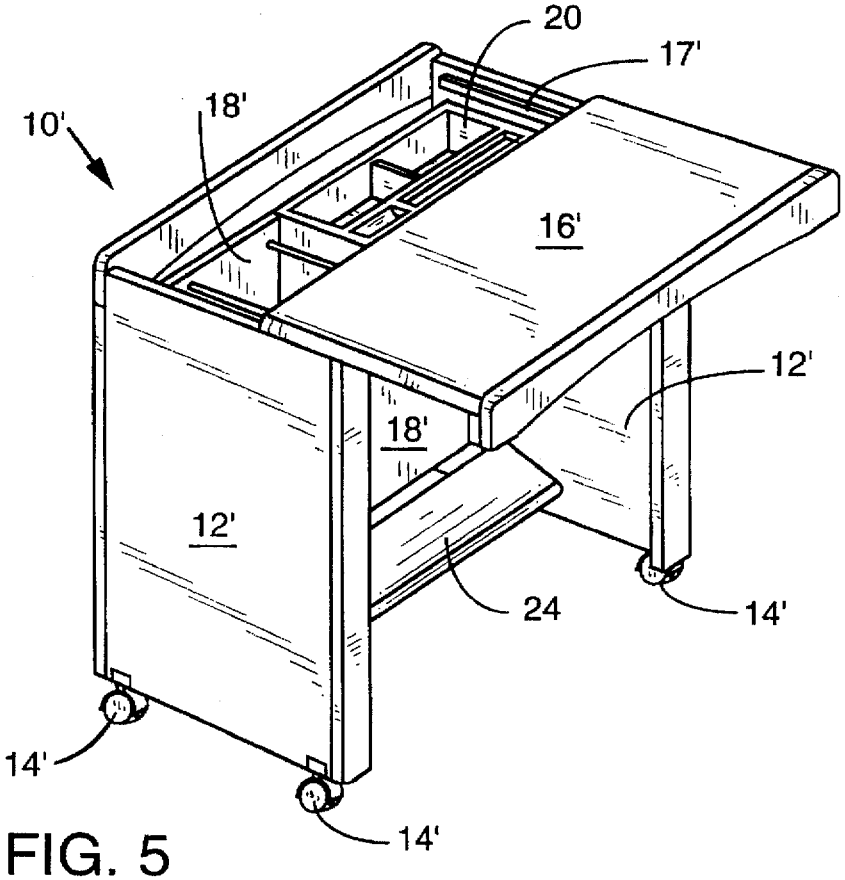
FIG. 5 is a perspective view of a laptop computer cart according to a second embodiment of the present invention with a desktop thereof in an open position.
Figure 6:
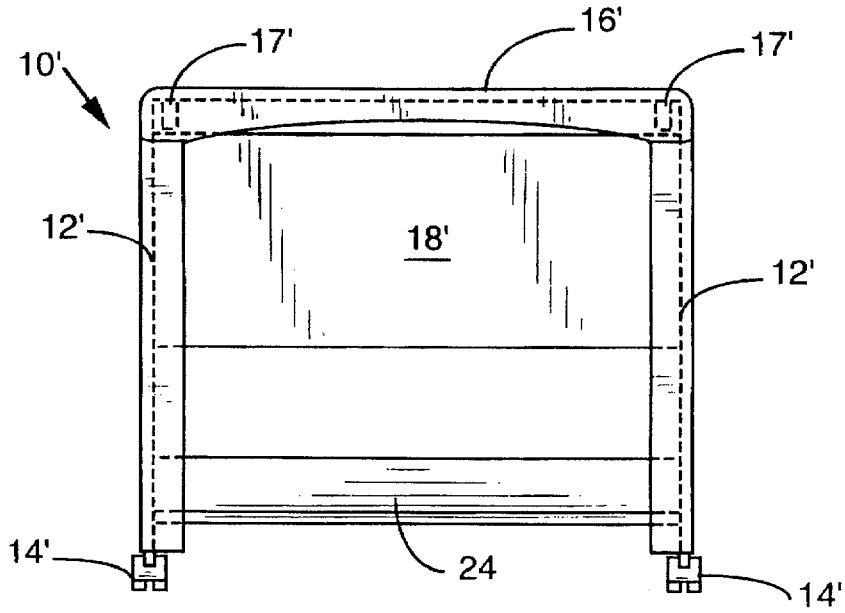
FIG. 6 is a front view of the laptop computer cart illustrated in FIG. 5.
Figure 7:
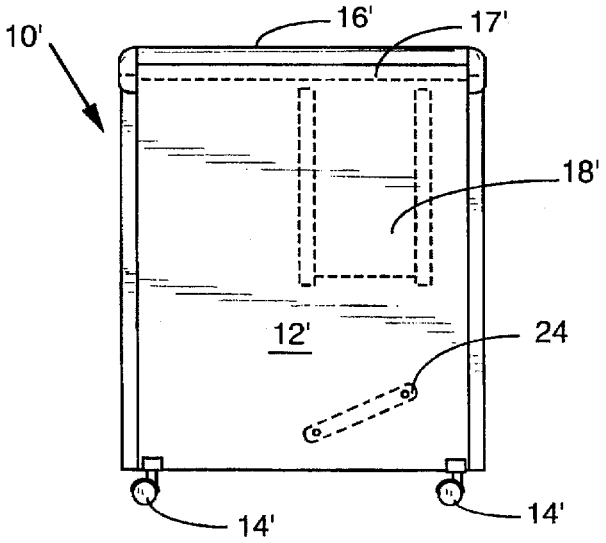
FIG. 7 is a side view of the laptop computer cart illustrated in FIG. 5 with the desktop in a closed position.

FIGS. 5–7 illustrate a modified laptop computer cart 10' according to a second embodiment of the present invention. The cart 10' includes substantially vertical spaced end panels 12' supported directly on casters or wheels 14'. A slidable desktop 16' on tracks 17' and hidden bin 18' are provided substantially the same as described above in connection with cart 10. The width of the end panels 12' is selected such that the casters or wheels 14' may be positioned appropriately to provide a stable base for the cart 10' even when the slidable desktop 16' is in the open position as shown in FIG. 5. Additionally, the cart 10' includes a footrest 24 provided on the bottom portion thereof extending between end panels 12'. Cart 10' operates substantially the same as cart 10 discussed above in connection with FIGS. 1–4.

Figure 8:
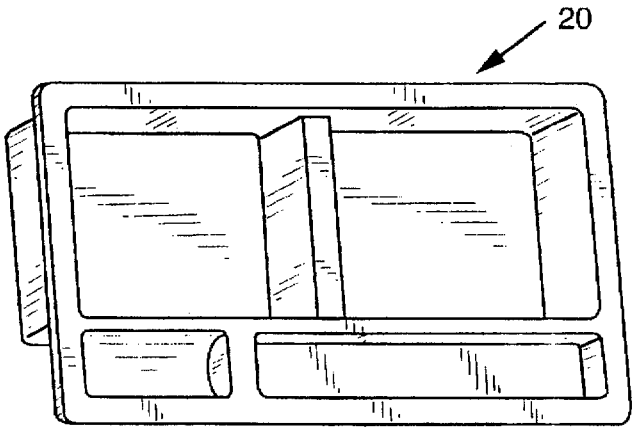
FIG. 8 is a perspective view of a plastic tray according to a first design for use with the laptop computer carts illustrated in FIGS. 1–7.
Figure 9:
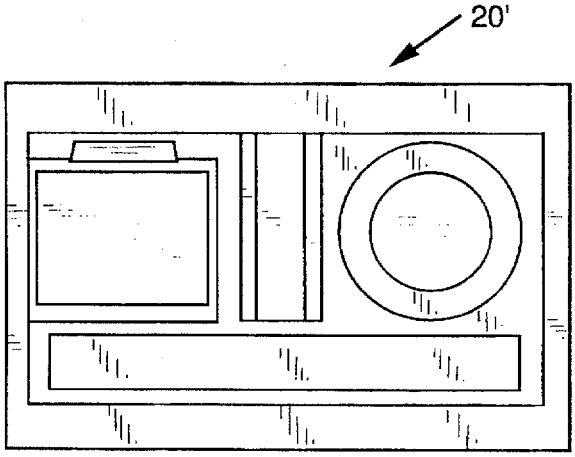
FIG. 9 is a plan view of a plastic tray according to a second design for use with the laptop computer carts illustrated in FIGS. 1–7.

FIGS. 8 and 9 illustrate separate embodiments of plastic trays 20 and 20' for use with the carts 10 or 10' described above in connection with FIGS. 1–7. Either plastic tray 20 or 20' is intended to overlap the vertical extending plates forming the bins 18 and 18' discussed above. The plastic trays 20 and 20' include a plurality of specifically shaped compartments therein for storage. As illustrated in FIG. 9, the plastic tray 20' may include a cup-holding compartment as well as a shallow pencil-holding tray and various compartments which can be used for storing diskettes, paper clips or the like.

Although several embodiments of the present invention have been described with particularity herein, it will be apparent to those of ordinary skill in the art that various modifications may be made to the present invention without departing from the spirit and scope of the present invention. The scope of the present invention is defined in the attached claims.

What is claimed is:

1. A laptop computer cart comprising:

a pair of vertically extending, spaced end panels each having a forward edge and a rearward edge and supported on roller means;

a slidable desktop extending between said vertically extending end panels and movable between a fully retracted position substantially over said end panels and an extended, operable position where at least a portion of said desktop extends beyond said forward edge of each said end panel; and a storage bin extending between and attached to said end panels in a position spaced from said forward edge of each said end panel wherein said storage bin is hidden by said desktop in said retracted position, and wherein a space between said end panels from said storage bin to said forward edge of each said end panel is substantially open.

2. The laptop computer cart of claim 1 wherein said roller means includes a horizontally extending brace attached to each said end panel and a pair of casters attached to opposite ends of each said brace.

3. The laptop computer cart of claim 2 wherein each said brace extends beyond said forward edge of said attached end panel.

4. The laptop computer cart of claim 1 further comprising a compartmentalized tray supported on said storage bin.

5. The laptop computer cart of claim 4 wherein said roller means includes a horizontally extending brace attached to each said end panel and a pair of casters attached to opposite ends of each said brace.

6. The laptop computer cart of claim 5 wherein each said brace extends beyond a forward edge of said attached end panel.

7. The laptop computer cart of claim 1 further including tracks attached to said end panels, said tracks slidably supporting said desktop.

8. The laptop computer cart of claim 7 wherein said roller means includes a horizontally extending brace attached to each said end panel and a pair of casters attached to opposite ends of each said brace.

9. The laptop computer cart of claim 8 wherein each said brace extends beyond a forward edge of said attached end panel.

10. The laptop computer cart of claim 9 further including a substantially cylindrical depression formed in said desktop to provide a cup receiver therein.

11. The laptop computer cart of claim 1 wherein said bin includes a pair of spaced vertical plates extending between and attached to said end panels, and a horizontal plate extending between and attached to said spaced vertical plates at a lower portion thereof.

12. The laptop computer cart of claim 11 wherein said roller means includes a horizontally extending brace attached to each said end panel and a pair of casters attached to opposite ends of each said brace.

13. The laptop computer cart of claim 12 wherein each said brace extends beyond a forward edge of said attached end panel.

14. The laptop computer cart of claim 13 further comprising a compartmentalized tray supported on said spaced vertical plates of said storage bin.

15. The laptop computer cart of claim 14 further including tracks attached to said end panels, said tracks slidably supporting said desktop.

16. The laptop computer cart of claim 15 further including a depression formed in said desktop to provide a cup-holding receiver therein.

17. The laptop computer cart of claim 1 further including a footrest extending between said end panels below said storage bin wherein a user's foot is adapted to engage said footrest through said substantially open space between said end panels from said storage bin to said forward edge of each said end panel.

* * * * *